US008198795B2

(12) United States Patent
Liao

(10) Patent No.: US 8,198,795 B2
(45) Date of Patent: Jun. 12, 2012

(54) BULB STRUCTURE OF ASSEMBLING-TYPE CAR LAMP

(75) Inventor: Ming-Hong Liao, Taipei Hsien (TW)

(73) Assignee: EIKO (Pacific) Ltd., Port Louis (MU)

( * ) Notice: Subject to any disclaimer, the term of this patent is extended or adjusted under 35 U.S.C. 154(b) by 170 days.

(21) Appl. No.: 12/703,742

(22) Filed: Feb. 10, 2010

(65) Prior Publication Data

US 2011/0193472 A1 Aug. 11, 2011

(51) Int. Cl.
*H01J 5/48* (2006.01)
*H01J 5/50* (2006.01)

(52) U.S. Cl. ..... 313/318.01; 313/318.04; 313/318.09; 362/548; 362/649; 362/655

(58) Field of Classification Search ..... 313/318.01; 362/548, 263, 216
See application file for complete search history.

(56) References Cited

U.S. PATENT DOCUMENTS

| | | | | |
|---|---|---|---|---|
| 1,450,079 | A * | 3/1923 | Hawthorne | 362/288 |
| 4,679,128 | A * | 7/1987 | Van Duyn et al. | 362/306 |
| 5,664,870 | A * | 9/1997 | Uchida et al. | 362/459 |
| 6,082,883 | A * | 7/2000 | Tatsumi et al. | 362/548 |
| 6,710,526 | B1 * | 3/2004 | Helbig | 362/640 |
| 7,018,073 | B2 * | 3/2006 | Koegler et al. | 362/296.05 |
| 7,264,391 | B2 * | 9/2007 | Kaandorp | 362/649 |
| 2004/0100372 | A1 * | 5/2004 | Yang | 340/473 |
| 2005/0041420 | A1 * | 2/2005 | Tiesler-Wittig et al. | 362/226 |
| 2011/0081806 | A1 * | 4/2011 | Lin | 439/620.21 |

FOREIGN PATENT DOCUMENTS

JP 2000077036 A * 3/2000

OTHER PUBLICATIONS

Machine English translation of JP 2000077036 to Kokado, published Mar. 2000.*

* cited by examiner

*Primary Examiner* — Sikha Roy
(74) *Attorney, Agent, or Firm* — CKC & Partners Co., Ltd.

(57) ABSTRACT

A bulb structure of assembling-type car lamp includes a lamp housing and a bulb unit. The bulb unit includes a mounting base, a bulb holder, and a bulb. The mounting base includes electric pins, a forward raised seat, and a rearward protruded annular ring portion. The annular ring portion is externally provided with anti-slip ribs to facilitate easy turning and assembling of the bulb unit to the lamp housing. The bulb holder includes a holding seat and an adjusting seat connected to the mounting base and the bulb, respectively; and the bulb is electrically connected to the electric pins. By adjusting the adjusting seat relative to the holding seat, the bulb can be adjusted in position and focal length. A cover plate is closed to a rear open end of the annular ring portion to isolate joints of the bulb and the electric pins from external air, dust and water.

6 Claims, 7 Drawing Sheets

BULB STRUCTURE OF ASSEMBLING-TYPE CAR LAMP

FIELD OF THE INVENTION

The present invention relates to a bulb structure, and more particularly to a bulb structure of assembling-type car lamp.

BACKGROUND OF THE INVENTION

FIG. 1 is a perspective view showing a conventional car lamp structure, which includes a bulb portion 700 and a lamp housing 800 that are integrally formed through sinter molding, such as a sinter-molded glass lamp housing, with two electric pins 710 of the bulb portion 700 rearward projected from the lamp housing 800. Each of the electric pins 710 has a connecting strip 720 welded thereto for connecting with external wires (not shown).

The conventional integrally formed car lamp structure as shown in FIG. 1 has the following disadvantages in terms of its manufacture and use: (1) it is troublesome and inconvenient to integrally form the bulb portion 700 and the lamp housing 800 by way of sinter-molding; that is, the bulb portion 700 must be manufactured first, and then the lamp housing 800 and the bulb portion 700 are sintered together; the bulb portion 700 and the lamp housing 800 could not be independently mass-produced and then assembled to each other in a simple manner; and (2) the bulb portion 700 is not replaceable independently; that is, in the event the bulb portion 700 is damaged in the process of manufacturing or burned out while in use, the whole car lamp structure including the lamp housing 800 and the bulb portion 700 must be discarded at the same time to thereby cause waste in material and cost.

To overcome the disadvantages of the conventional integrally formed car lamp structure as shown in FIG. 1, U.S. patent application Ser. No. 12/647,326 entitled "Assembling-type Car Lamp" was filed by the same applicant of the present invention. FIG. 2 is an exploded rear perspective view showing that the assembling-type car lamp disclosed in U.S. patent application Ser. No. 12/647,326 includes a lamp housing 100 and a bulb unit 900. The lamp housing 100 is provided at a predetermined position with an assembling hole 110. A plurality of ribs 120 are circumferentially extended and spaced along an inner wall surface of the assembling hole 110, such that a notch 130 is formed between any two adjacent ribs 120. The bulb unit 900 includes a mounting base 910, a bulb holder 920, and a bulb 930. The mounting base 910 includes a plurality of electric pins 911, an round plate 912, and a raised seat 913 forward projected from the round plate 912. The raised seat 913 is provided on an outer wall surface thereof with a plurality of circumferentially spaced guide blocks 914 located corresponding to the notches 130, such that an annular space 915 is defined between the guide blocks 914 and the round plate 912. The bulb 930 is mounted on the mounting base 910 via the bulb holder 920 and is electrically connected to the plurality of electric pins 911. By aligning the guide blocks 914 on the bulb unit 900 with the notches 130 on the lamp housing 100 and fitting the bulb unit 900 in the assembling hole 110, and then turning the bulb unit 900 for the ribs 120 on the lamp housing 100 to move into the annular space 915 on the bulb unit 900, the bulb unit 900 can be conveniently assembled to the lamp housing 100 for use or for replacement.

However, the assembling-type car lamp disclosed in U.S. patent application Ser. No. 12/647,326 still has the following disadvantages in use: (1) to assemble or disassemble the bulb unit 900 to or from the lamp housing 100, the bulb unit 900 is turned for the round plate 912 to tightly fit in or loosen from the assembling hole 110 on the lamp housing 100. However, the bulb unit 900 is not provided thereon with any portion for a user to properly grip at in order to conveniently turn the bulb unit 900; (2) the bulb 930 is fixedly mounted on the mounting base 910 via the bulb holder 920, and the bulb 930 is fixed in position relative to the bulb holder 920. Therefore, the bulb 930 is not adjustable in its position and focal length; and (3) joints between the bulb 930 and the electric pins 911 are exposed to an outer environment and therefore not dustproof, airtight and watertight.

SUMMARY OF THE INVENTION

It is therefore a primary object of the present invention to provide a bulb structure of assembling-type car lamp, which includes an easily turnable bulb unit.

Another object of the present invention is to provide a bulb structure of assembling-type car lamp, which allows a bulb thereof to be adjusted in position and focal length.

A further object of the present invention is to provide a bulb structure of assembling-type car lamp, which protects joints of a bulb and electric pins against external dust, air and water.

To achieve the above and other objects, the bulb structure of assembling-type car lamp according to an embodiment of the present invention includes a lamp housing and a bulb unit assembled to the lamp housing. The bulb unit includes a mounting base, a lamp holder, and a bulb. The mounting base has a plurality of electric pins, and includes a round plate, and a raised seat forward protruded from the round plate.

The bulb is mounted on the mounting base via the bulb holder to electrically connect to the electric pins. The bulb unit further includes an annular ring portion rearward protruded from one side of the round plate opposite to the raised seat. The annular ring portion is provided on an outer wall surface with a plurality of anti-slip ribs, and the electric pins are projected beyond the annular ring portion. When assembling or disassembling the bulb unit to or from the lamp housing, the rearward protruded annular ring portion and the anti-slip ribs provided thereon allow a user to comfortably grip at and easily turn the bulb unit.

According to an embodiment of the present invention, the bulb holder includes a holding seat and an adjusting seat connected to the holding seat, and the adjusting seat is position-adjustable relative to the holding seat to allow adjustment of the position and focal length of the bulb connected to the adjusting seat.

According to an embodiment of the present invention, the raised seat of the mounting base internally defines a receiving space, the holding seat of the bulb holder is fixedly received in the receiving space, and the bulb is fixedly connected to the adjusting seat, such that the holding seat and the adjusting seat are connected to the mounting base and the bulb, respectively.

According to an embodiment of the present invention, the holding seat has a ring body with a plurality of clamping plates spaced along a front edge of the ring body, and the adjusting seat is positioned in between the clamping plates and clamped in place by the clamping plate. Thus, the clamping plates form an adjusting and holding structure between the adjusting seat and the holding seat.

According to an embodiment of the present invention, the ring body of the holding seat further has at least one pair of spaced locating plates provided at a rear edge thereof, and the receiving space defined in the raised seat is provided on a peripheral wall thereof with at least one pair of locating slots corresponding to the locating plates, such that the holding seat is fixedly received in the receiving space with the locating plates separately tightly inserted in the locating slots.

According to an embodiment of the present invention, the bulb has an insertion leg and is connected to the adjusting seat by securely inserting the insertion leg in an insertion hole formed on the adjusting seat.

According to an embodiment of the present invention, the bulb unit further includes a cover plate closed to a rear open end of the annular ring portion. The cover plate is provided with a plurality of through holes in a number and at positions corresponding to those of the electric pins, so that the electric pins are projected beyond the cover plate via the through holes. By closing the cover plate to the rear open end of the annular ring portion, joints of the bulb and the electric pins are isolated from external dust, air and water.

According to an embodiment of the present invention, the cover plate is provided along a circumferential outer wall surface with a radially protruded flange, and the annular ring portion is provided on an inner wall surface of the rear open end with an annular groove corresponding to the flange, so that the cover plate is closed to the annular ring portion with the flange clamped in the annular groove.

According to an embodiment of the present invention, the round plate is provided on the side having the raised seat with an annular recess, which is extended around an outer side of the raised seat and has a watertight adhesive filled therein, so that the bulb unit can be assembled to the lamp housing in an airtight and watertight manner.

According to an embodiment of the present invention, the lamp housing is provided at a predetermined position with an assembling hole, which is provided along an inner wall surface with a plurality of circumferentially extended and spaced ribs, such that a notch is formed between any two adjacent ribs; and the raised seat of the bulb unit is provided on an outer wall surface thereof with a plurality of circumferentially spaced guide blocks located corresponding to the notches on the lamp housing, such that an annular space is defined between the guide blocks and the round plate; and the ribs on the lamp housing can be moved into the annular space to assemble the bulb unit to the lamp housing.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof with reference to the accompanying drawings.

Figure 1:
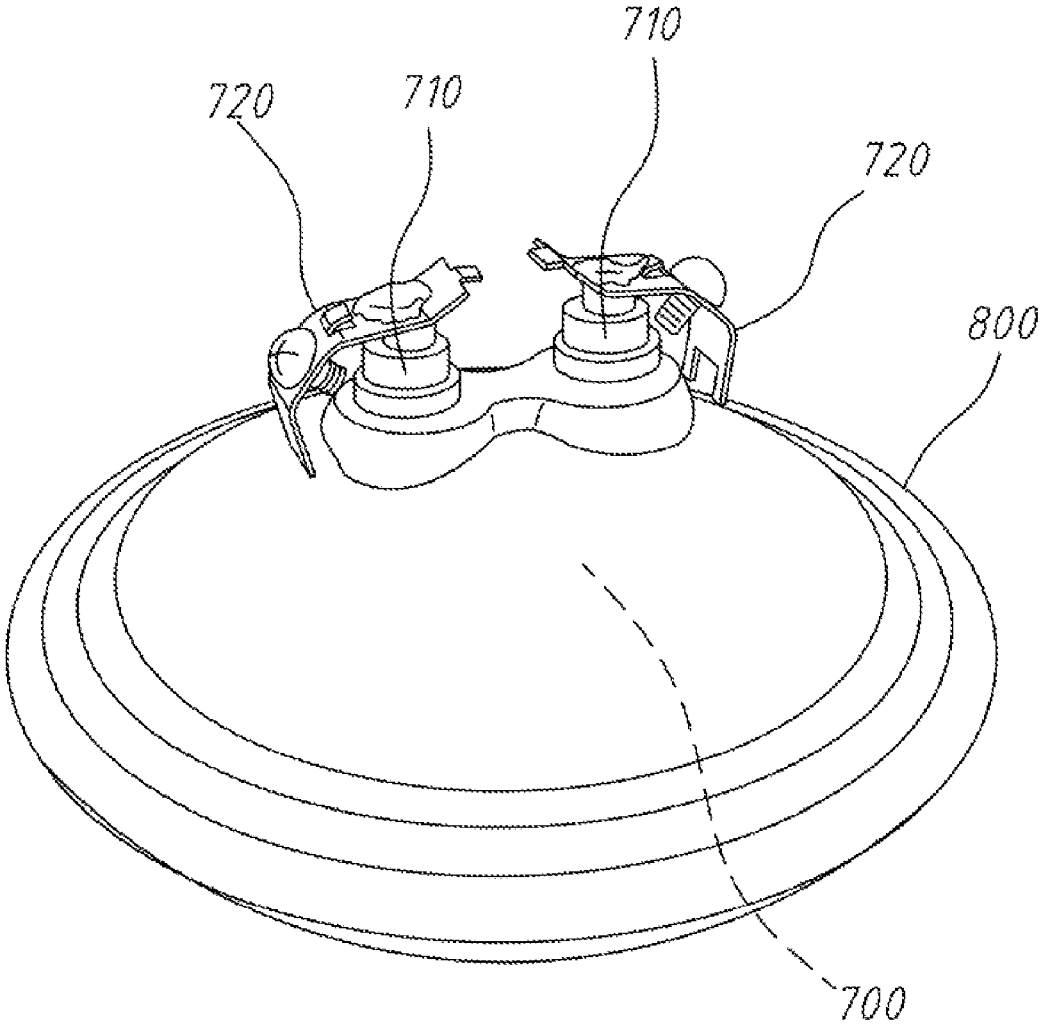
Fig. 1 (Prior Art)
FIG. 1 is a perspective view showing a conventional car lamp structure.
Figure 2:
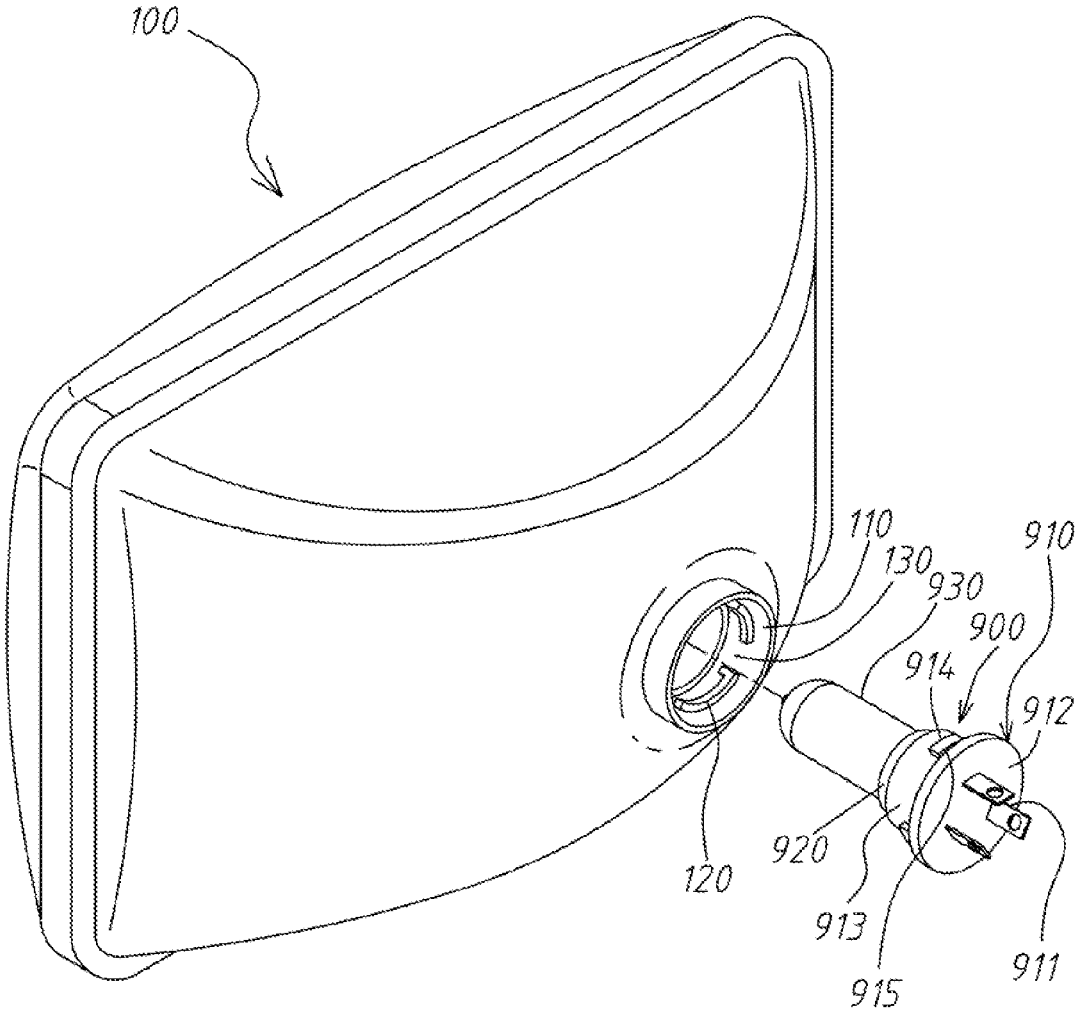
Fig. 2 (Prior Art)
FIG. 2 is an exploded rear perspective view of a conventional assembling-type car lamp disclosed in U.S. patent application Ser. No. 12/647,326 filed by the same applicant of the present invention.
Figure 3:
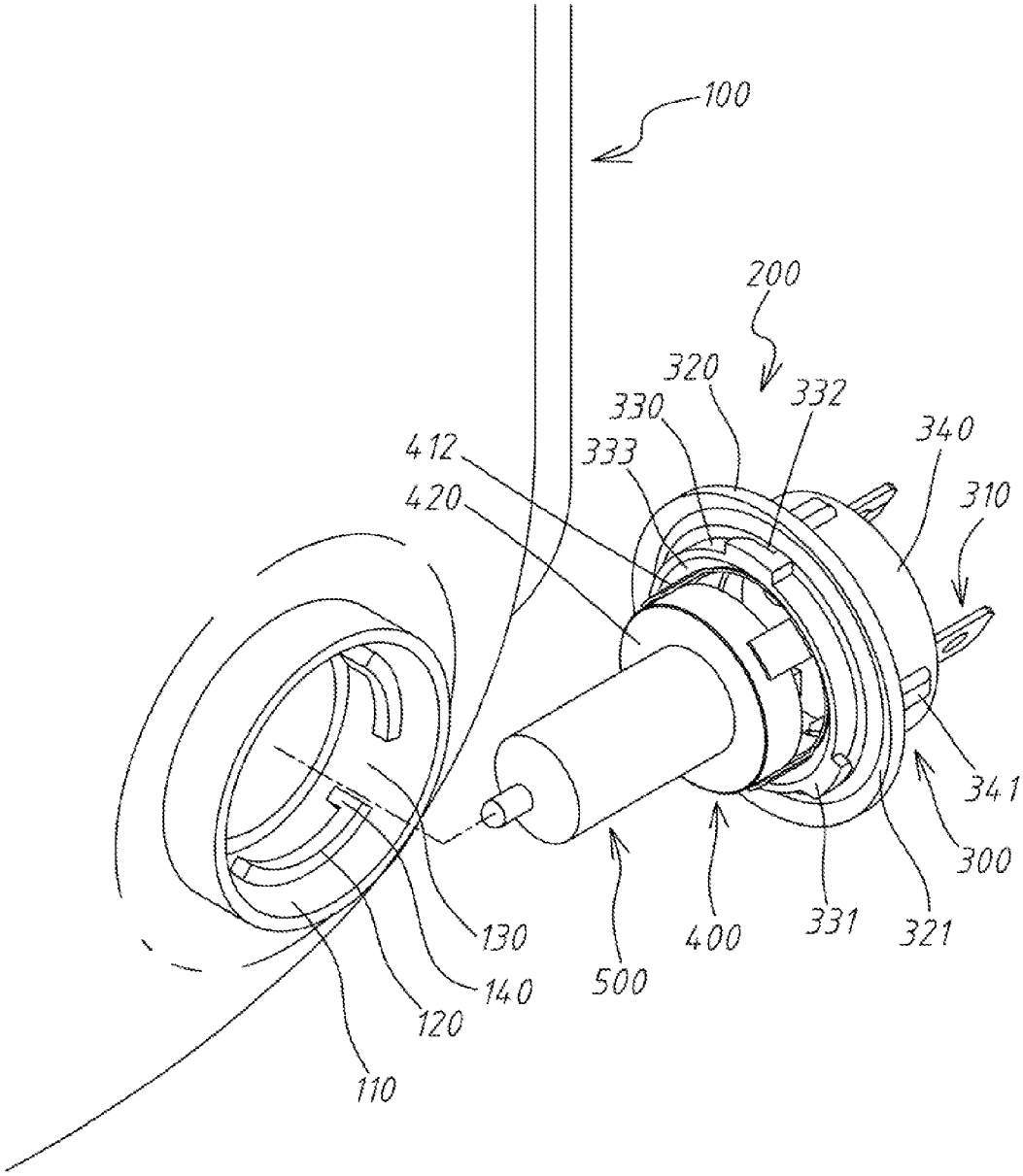
FIG. 3 is an exploded perspective view of a bulb structure of assembling-type car lamp according to an embodiment of the present invention.
Figure 4:
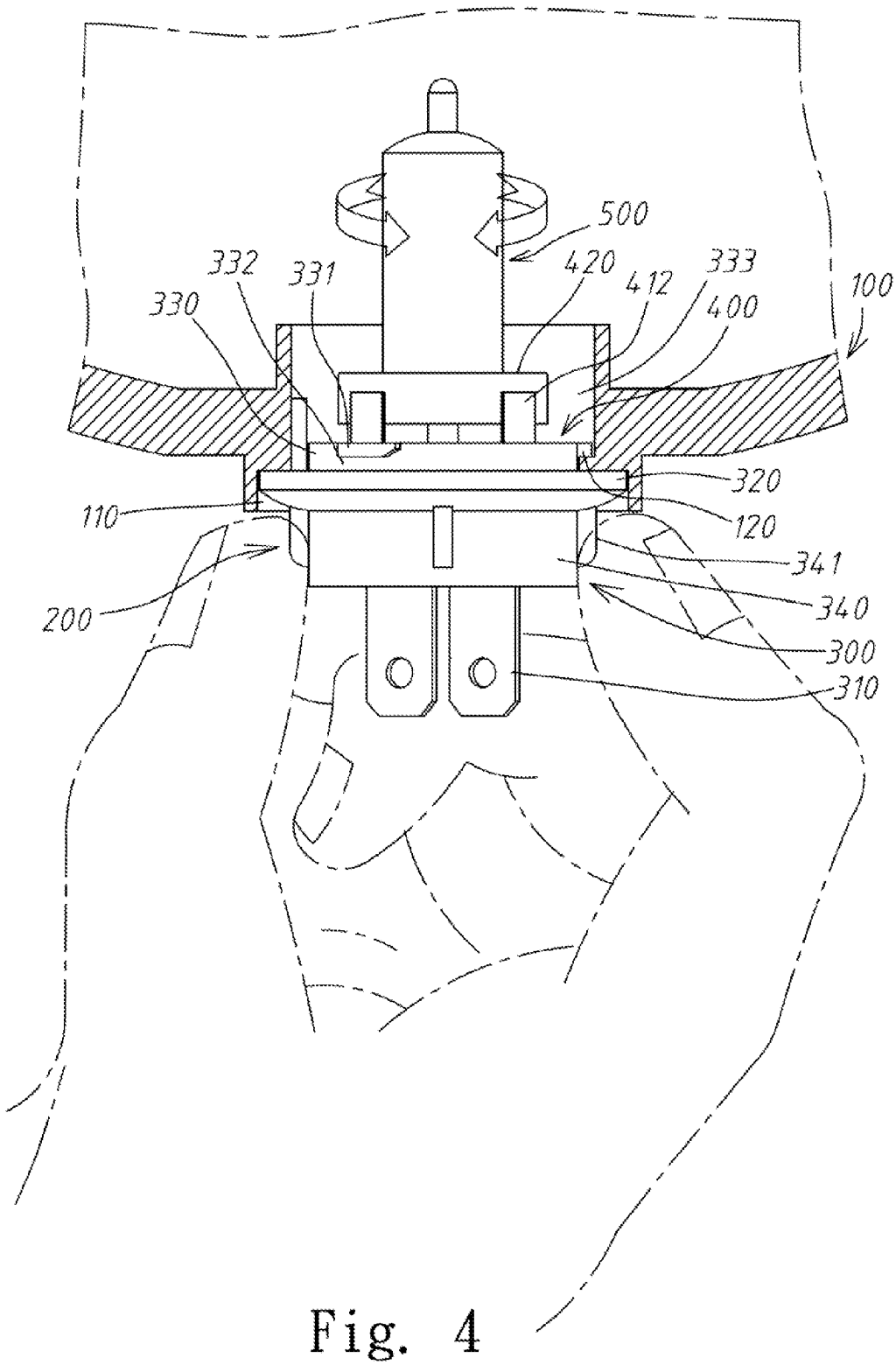
FIG. 4 is an assembled partially sectioned side view of the bulb structure of assembling-type car lamp according to FIG. 3, showing the manner of assembling a bulb unit to a lamp housing thereof.
Figure 5:
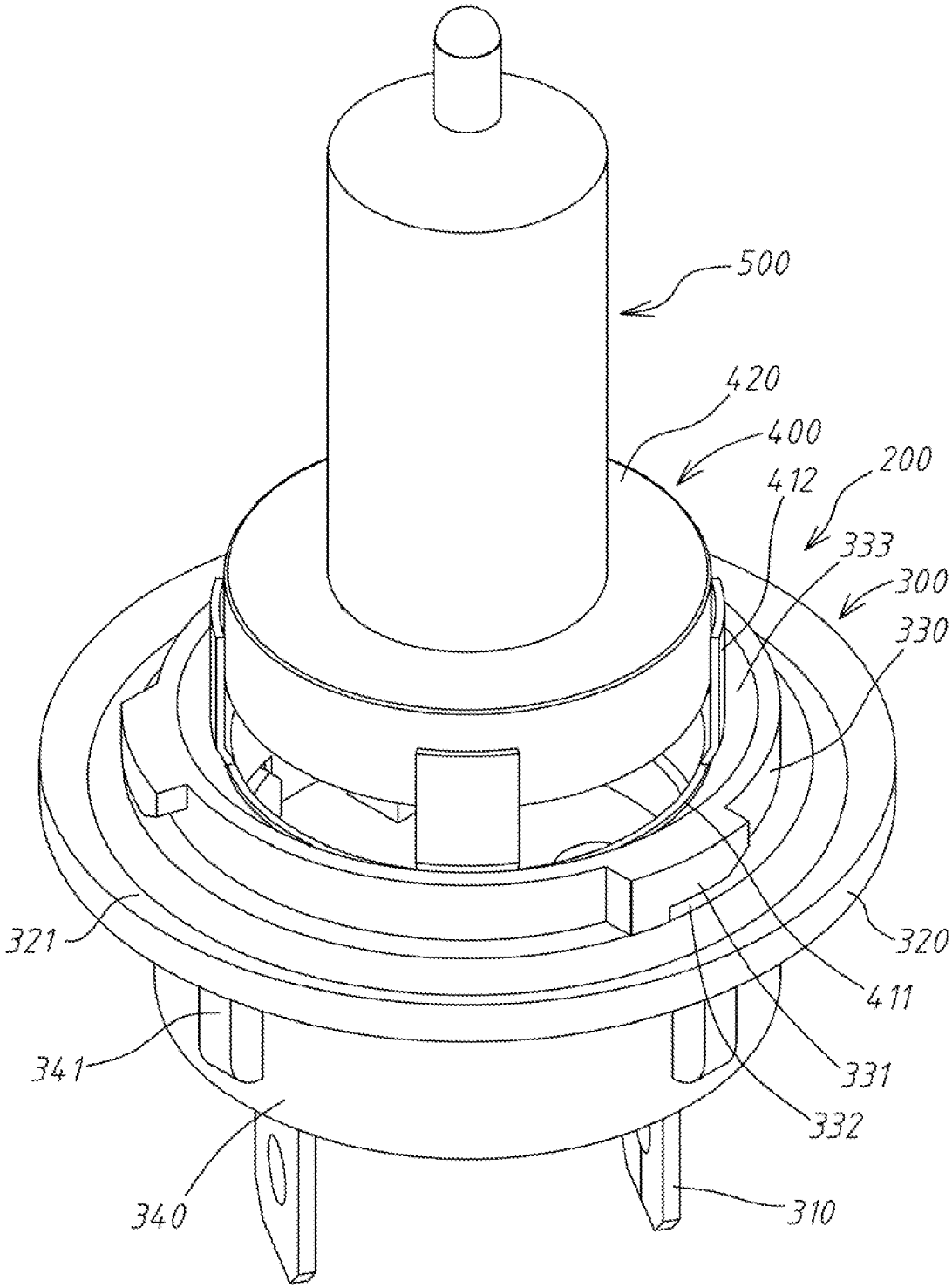
FIG. 5 is an assembled perspective view of the bulb unit for the bulb structure of assembling-type car lamp according to FIG. 3.
Figure 6:
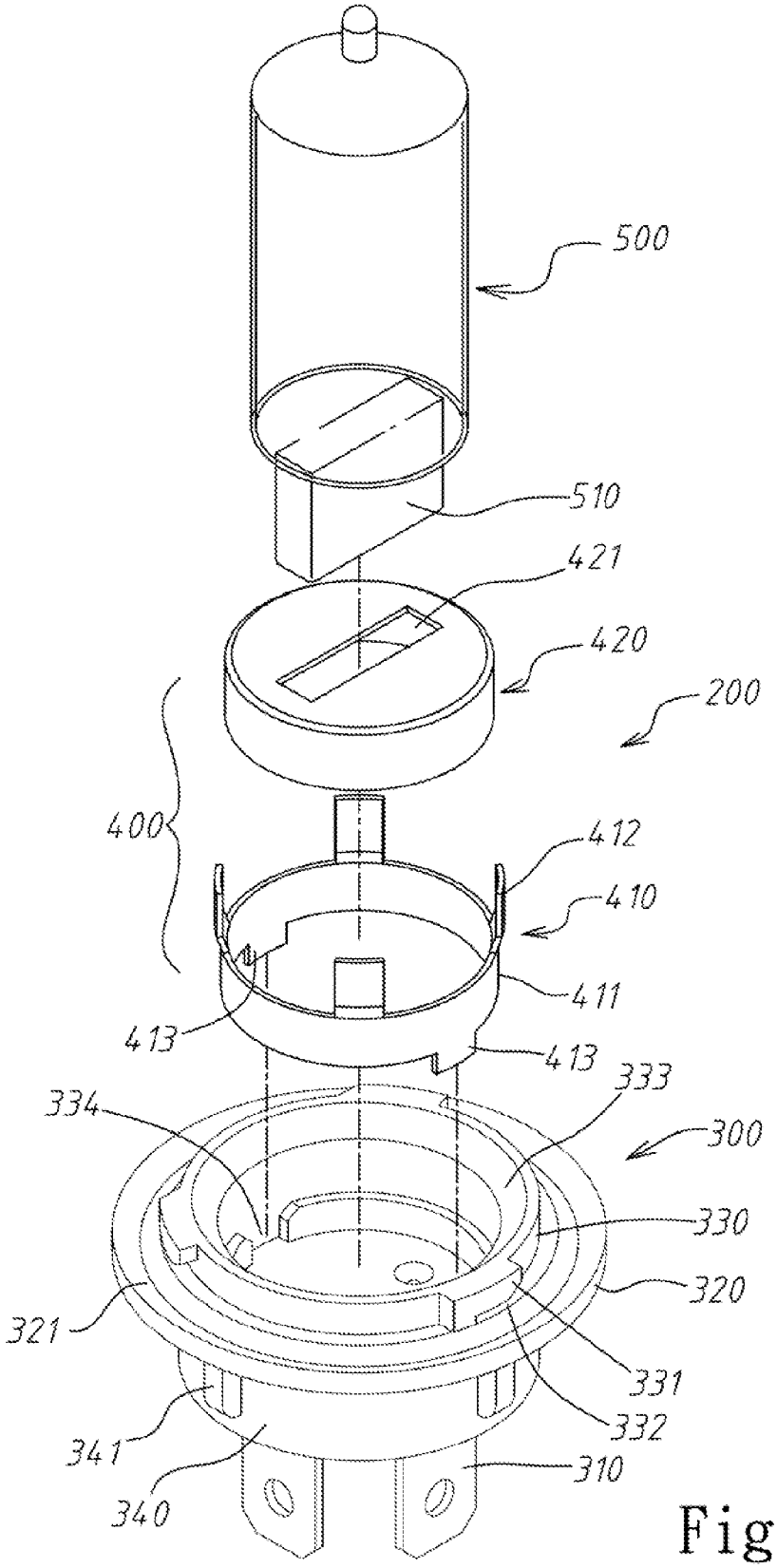
FIG. 6 is an exploded view of the bulb unit of FIG. 5.
Figure 7:
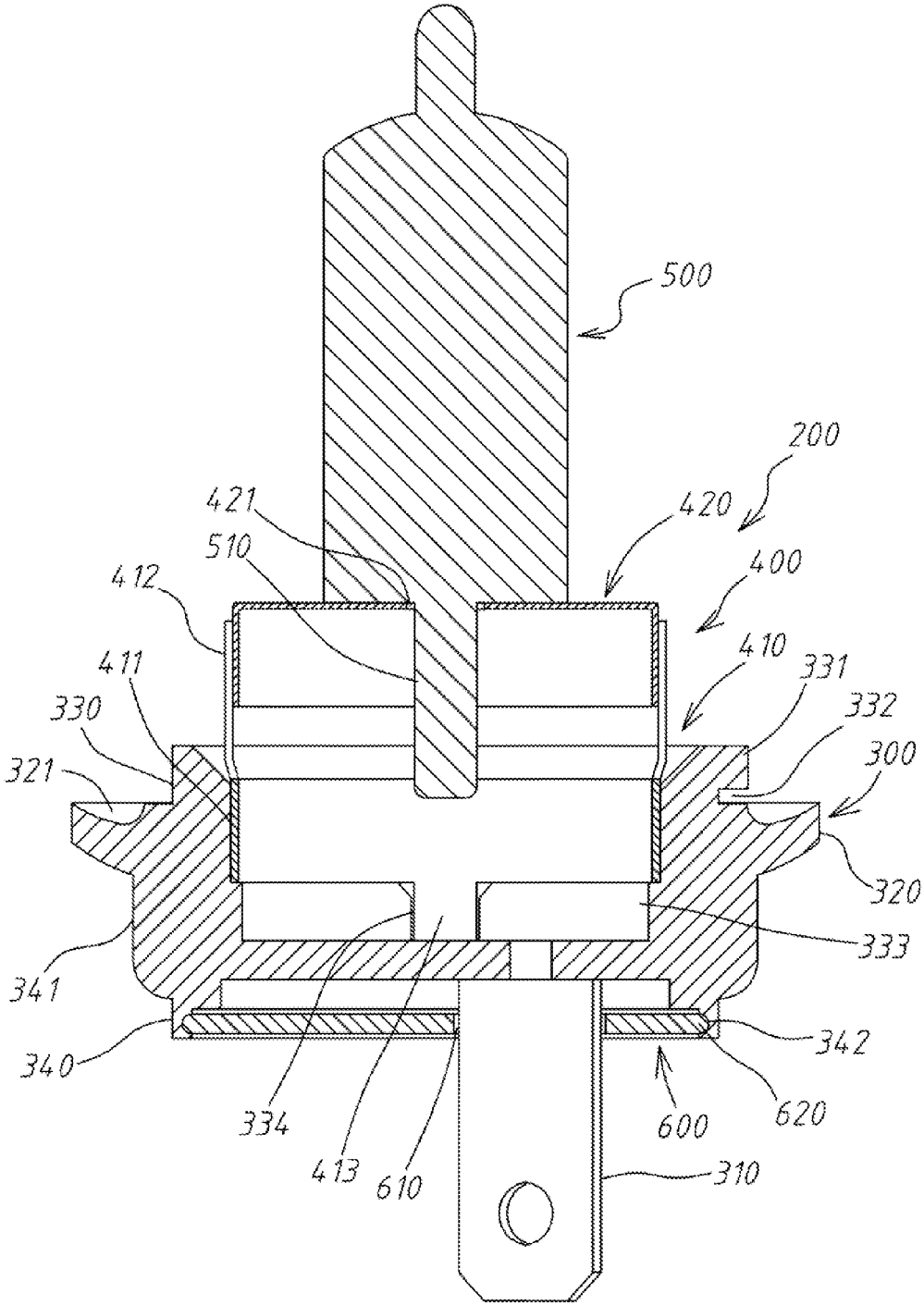
FIG. 7 is a sectioned side view of the bulb unit of FIG. 5.

Please refer to FIGS. 3 and 4 that are an exploded perspective view and an assembled partially sectioned side view, respectively, of a bulb structure of assembling-type car lamp according to an embodiment of the present invention; to FIGS. 5 and 6 that are assembled and exploded perspective views, respectively, of a bulb unit for the bulb structure of assembling-type car lamp shown in FIG. 3; and to FIG. 7 that is a sectioned side view of the bulb unit of FIG. 5. As shown, the bulb structure of assembling-type car lamp according to an embodiment of the present invention includes a lamp housing 100 and a bulb unit 200.

The lamp housing 100 can be made of, for example, a plastic material by molding, and has a reflecting layer (not shown) coated on a front wall surface thereof. Further, the lamp housing 100 is provided at a rear end portion with an assembling hole 110, to which the bulb unit 200 is assembled.

A plurality of ribs 120 are circumferentially extended and spaced along an inner wall surface of the assembling hole 110, such that a notch 130 is formed between any two adjacent ribs 120. The notches 130 cooperate with related parts of the bulb unit 200 to assemble the bulb unit 200 to the lamp housing 100. The ribs 120 are respectively provided at the same end with a sideward extended stop lug 140 oriented toward a front side of the lamp housing 100.

The bulb unit 200 includes a mounting base 300, a bulb holder 400, and a bulb 500.

The mounting base 300 is provided with a plurality of electric pins 310, and includes a round plate 320 and a raised seat 330 forward projected from the round plate 320. The raised seat 330 is provided on an outer wall surface thereof with a plurality of circumferentially spaced guide blocks 331 located corresponding to the notches 130 on the lamp housing 100, such that an annular space 332 is defined between the guide blocks 331 and the round plate 320. The raised seat 330 internally defines a receiving space 333. An annular ring portion 340 is rearward protruded from one side of the round plate 320 opposite to the raised seat 330, and a plurality of anti-slip ribs 341 are formed on an outer wall surface of the annular ring portion 340. The electric pins 310 are rearward projected beyond the annular ring portion 340.

The bulb holder 400 includes a holding seat 410 and an adjusting seat 420 held in the holding seat 410 in a position-adjustable manner. In implementing the present invention, the holding seat 410 includes a ring body 411 and a plurality of clamping plates 412 spaced along a front edge of the ring body 411. The adjusting seat 420 is clamped in between the clamping plates 412, and can be adjusted to a desired position relative to the clamping plates 412. When the adjusting seat 420 has been adjusted to the desired position, it can be further welded to the clamping plate 412. In this manner, the adjusting seat 420 can be fixed to the desired position to maintain a stable and secure connection of the adjusting seat 420 to the holding seat 410. When the adjusting seat 420 is adjusted in its position relative to the holding seat 410, the bulb 500 connected to the adjusting seat 420, as will be described later, is also adjusted in position. That is, the bulb 500 can be adjusted in position and accordingly, the focal length thereof for the car lamp to reach an optimal operating state.

The holding seat 410 is fixedly received in the receiving space 333 defined in the mounting base 300. In implementing the present invention, the ring body 411 of the holding seat 410 is provided on a rear edge with a pair of locating plates 413, and the receiving space 333 is provided on a peripheral wall thereof with a pair of locating slots 334 corresponding to the locating plates 413. The holding seat 410 is received in the receiving space 333 with the locating plates 413 separately tightly inserted in the locating slots 334, so that the holding seat 410 is firmly held to the mounting base 300.

The bulb 500 is fixedly connected to the adjusting seat 420. In implementing the present invention, the adjusting seat 420 is provided with an insertion hole 421, and the bulb 500 is provided with an insertion leg 510. The bulb 500 is securely connected to the adjusting seat 420 by firmly inserting the insertion leg 510 in the insertion hole 421. The bulb 500 also has a plurality of electric wires (not shown), which are extended through the round plate 320 to separately connect to the electric pins 310. A waterproof adhesive (not shown) is further applied to joints of the electric wires and the electric pins 310.

As can be seen in FIG. 7, a cover plate 600 is closed to a rear open end of the annular ring portion 340 of mounting base 300. The cover plate 600 is provided with a plurality of through holes 610 in a number and at positions corresponding to those of the electric pins 310, so that the electric pins 310 are projected beyond the cover plate 600 via the through holes 610. The cover plate 600 is provided on a circumferential outer wall surface with a radially protruded flange 620, and the annular ring portion 340 is provided on an inner wall surface of the rear open end with an annular groove 342 corresponding to the flange 620, so that the cover plate 600 is closed to the rear open end of the annular ring portion 340 with the flange 620 clamped in the annular groove 342.

To assemble the bulb unit 200 to the lamp housing 100, simply align the guide blocks 331 on the bulb unit 200 with the notches 130 in the assembling hole 110 on the lamp housing 100 and move the bulb unit 200 through the assembling hole 110, and turn the bulb unit 200 for the ribs 120 in the assembling hole 110 to move into the annular space 332 between the round plate 320 and the guide blocks 331. Then, the bulb unit 200 is further turned until the guide blocks 331 are abutted on the stop lugs 140. At this point, the bulb unit 200 is exactly assembled to the lamp housing 100. When it is desired to remove the bulb unit 200 from the lamp housing 100 or replace the bulb unit 200 with another one, simply turn the bulb unit 200 reversely to separate the bulb unit 200 from the lamp housing 100. Therefore, the bulb unit 200 can be conveniently assembled to and disassembled from the lamp housing 100 for use or for replacement.

Further, the round plate 320 is provided on the side having the raised seat 330 with an annular recess 321, which is extended around an outer side of the raised seat 330. A watertight adhesive (not shown) is filled in the annular recess 321 to ensure an airtight and watertight assembling of the bulb unit 200 to the lamp housing 100.

The bulb structure of assembling-type car lamp according to the present invention provides at least the following advantages: (1) the annular ring portion 340 is rearward protruded from the round plate 320 and the anti-slip ribs 341 are formed on the outer wall surface of the annular ring portion 340, allowing a user to comfortably and stably grip at the annular ring portion 340 and turn the bulb unit 200 in an easy and convenient manner; (2) the bulb holder 400 includes the holding seat 410 and the adjusting seat 420, allowing a user to adjust the bulb 500 to the desired position and focal length before the bulb 500 is finally fixedly held to the holding seat 410; and (3) the cover plate 600 is provided to close the rear open end of the annular ring portion 340 on the mounting base 300, preventing the joints of the bulb 500 and the electric pins 310 from exposing to the external environment and allowing the bulb unit 200 to be airtight, dustproof and watertight.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A bulb structure of assembling-type car lamp, comprising a lamp housing and a bulb unit assembled to the lamp housing; the bulb unit having a mounting base, a bulb holder, and a bulb; the mounting base being provided with a plurality of electric pins and including a round plate and a raised seat forward protruded from the round plate; the bulb being mounted on the mounting base via the bulb holder to electrically connect to the electric pins; the bulb unit further having an annular ring portion rearward protruded from one side of the round plate opposite to the raised seat; the annular ring portion being formed on an outer wall surface with a plurality of anti-slip ribs; and the electric pins being rearward projected beyond the annular ring portion, wherein the bulb holder includes a holding seat and an adjusting seat, and the adjusting seat being held in the holding seat in a position-adjustable manner, wherein the raised seat of the mounting base internally defining a receiving space, the holding seat of the bulb holder being fixedly received in the receiving space, and the bulb being fixedly connected to the adjusting seat, wherein the holding seat includes a ring body having a plurality of clamping plates spaced along a front edge thereof; and the adjusting seat being positioned in between the clamping plates and clamped in place by the clamping plates, wherein the ring body of the holding seat further has at least one pair of spaced locating plates provided at a rear edge thereof, and the receiving space defined in the raised seat is provided on a peripheral wall thereof with a pair of locating slots corresponding to the locating plates, and the holding seat being received in the receiving space with the locating plates separately tightly inserted in the locating slots, wherein the bulb unit further having a cover plate closed to a rear open end of the annular ring portion; and the cover plate being provided with a plurality of through holes in a number and at positions corresponding to those of the electric pins, so that the electric pins are projected beyond the cover plate via the through holes, wherein the cover plate is provided along a circumferential outer wall surface with a radially protruded flange, and the annular ring portion is provided on an inner wall surface of the rear open end with an annular groove corresponding to the flange.

2. The bulb structure of assembling-type car lamp as claimed in claim 1, wherein the adjusting seat is provided with an insertion hole and the bulb is provided with an insertion leg; and the bulb being securely connected to the adjusting seat by firmly inserting the insertion leg in the insertion hole.

3. The bulb structure of assembling-type car lamp as claimed in claim 2, wherein the lamp housing is provided at a predetermined position with an assembling hole; the assembling hole being provided along an inner wall surface thereof with a plurality of circumferentially extended and spaced ribs, such that a notch is formed between any two adjacent ribs; and the raised seat of the bulb unit being provided on an outer wall surface thereof with a plurality of circumferentially spaced guide blocks located corresponding to the notches on the lamp housing, such that an annular space is defined between the guide blocks and the round plate; and the ribs on the lamp housing being able to move into the annular space to assemble the bulb unit to the lamp housing.

4. The bulb structure of assembling-type car lamp as claimed in claim 1, wherein the round plate comprises an annular recess, and a watertight adhesive filled in the annular recess.

5. The bulb structure of assembling-type car lamp as claimed in claim 4, wherein the lamp housing is provided at a predetermined position with an assembling hole; the assembling hole being provided along an inner wall surface thereof with a plurality of circumferentially extended and spaced ribs, such that a notch is formed between any two adjacent ribs; and the raised seat of the bulb unit being provided on an outer wall surface thereof with a plurality of circumferentially spaced guide blocks located corresponding to the notches on the lamp housing, such that an annular space is defined between the guide blocks and the round plate; and the ribs on the lamp housing being able to move into the annular space to assemble the bulb unit to the lamp housing.

6. The bulb structure of assembling-type car lamp as claimed in claim 1, wherein the lamp housing is provided at a predetermined position with an assembling hole; the assembling hole being provided along an inner wall surface thereof with a plurality of circumferentially extended and spaced ribs, such that a notch is formed between any two adjacent ribs; and the raised seat of the bulb unit being provided on an outer wall surface thereof with a plurality of circumferentially spaced guide blocks located corresponding to the notches on the lamp housing, such that an annular space is defined between the guide blocks and the round plate; and the ribs on the lamp housing being able to move into the annular space to assemble the bulb unit to the lamp housing.

* * * * *